US006451136B1

(12) United States Patent
Falkenreck et al.

(10) Patent No.: US 6,451,136 B1
(45) Date of Patent: Sep. 17, 2002

(54) METHOD FOR PRODUCING HOT-ROLLED STRIPS AND PLATES

(75) Inventors: Udo Falkenreck, Bochum; Uwe Quitmann, Willich; Harald Wehage, Ilsenburg, all of (DE)

(73) Assignee: SMS Demag AG, Düsseldorf (DE)

( * ) Notice: Subject to any disclaimer, the term of this patent is extended or adjusted under 35 U.S.C. 154(b) by 0 days.

(21) Appl. No.: 09/787,158

(22) PCT Filed: Sep. 8, 1999

(86) PCT No.: PCT/DE99/02866

§ 371 (c)(1),
(2), (4) Date: Nov. 14, 2001

(87) PCT Pub. No.: WO00/15362

PCT Pub. Date: Mar. 23, 2000

(30) Foreign Application Priority Data

Sep. 14, 1998 (DE) ..... 198 43 200

(51) Int. Cl.[7] ..... C21D 8/02
(52) U.S. Cl. ..... 148/541; 148/661
(58) Field of Search ..... 148/541, 661

(56) References Cited

FOREIGN PATENT DOCUMENTS

| | | | | |
|---|---|---|---|---|
| EP | 587150 A1 | * | 9/1993 | ..... C21D/7/13 |
| EP | 688702 A1 | * | 5/1995 | ..... C21D/9/00 |
| JP | 58164751 | * | 3/1982 | ..... C22C/38/00 |
| JP | 62212001 | * | 9/1987 | ..... B21B/1/00 |
| JP | 63168260 | * | 7/1988 | ..... B22D/11/124 |

* cited by examiner

*Primary Examiner*—Deborah Yee
(74) *Attorney, Agent, or Firm*—Cohen, Pontani, Lieberman & Pavane

(57) ABSTRACT

A method for producing hot-rolled strip and plates in a production plant having a continuous casting installation for slabs 100–180 mm thick, descaling sprays, a single- or multiple-stand rolling unit with or without edging, a cooling interval, a heating furnace, and a Steckel mill. Between the continuous casting installation and the heating furnace, only the skin layer of the previously descaled slab is deformed in-line, recrystallized during and after deformation, and then cooled in several stages to a temperature below the $Ar_3$ transformation point and temporarily maintained there until the microstructural transformation of the recrystallized, fine-grained austenite to ferrite/pearlite has been completed.

5 Claims, 2 Drawing Sheets

$Ar_3$ AUSTENITE/FERRITE–PEARLITE TRANSFORMATION TEMPERATURE
$B_B$ BAINITE START TEMPERATURE
$M_B$ MARTENSITE START TEMPERATURE
$t_B$ QUENCHING (METHOD 1)
DESCALING (METHOD 2)
$t_{T1}$ START OF TRANSFORMATION (METHOD 1)
$t_{DR}$ DYNAMIC RECRYSTALLIZATION
$t_C$ CONTROLLED COOLING
$t_{T2}$ START OF TRANSFORMATION
$t_{Ch}$ LOADING THE FURNACE
$t_{SR}$ STATIC RECRYSTALLIZATION
$t_{SR} - t_{T2} - t_{DR}$

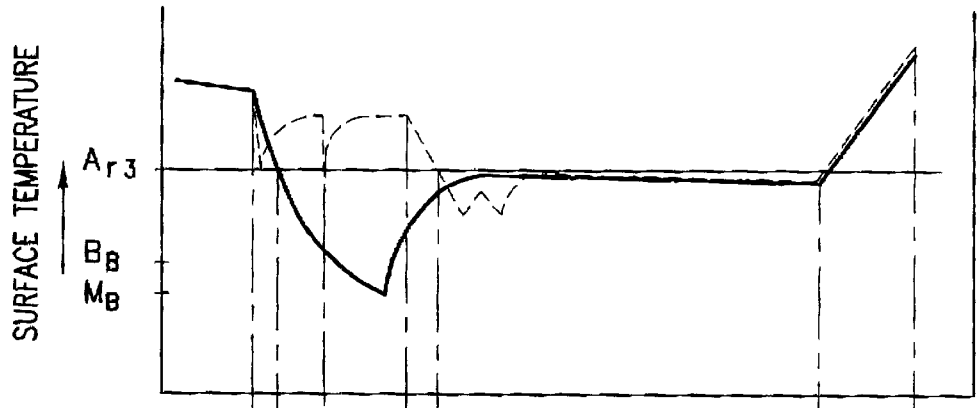

FIG. 1a

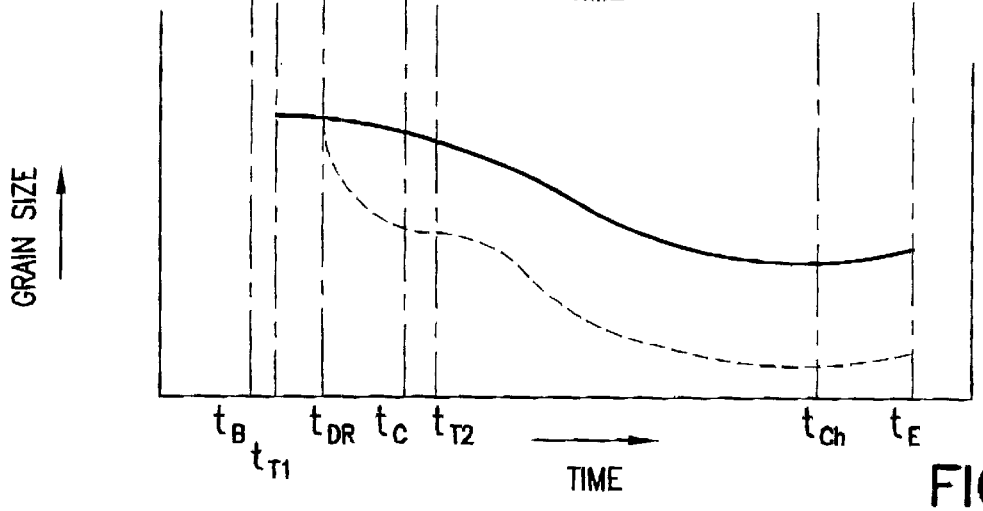

FIG. 1b

——— METHOD 1 (STATE OF THE ART)
- - - - METHOD 2 (INVENTION)

| | |
|---|---|
| $A_{r3}$ | AUSTENITE/FERRITE–PEARLITE TRANSFORMATION TEMPERATURE |
| $B_B$ | BAINITE START TEMPERATURE |
| $M_B$ | MARTENSITE START TEMPERATURE |
| $t_B$ | QUENCHING (METHOD 1)<br>DESCALING (METHOD 2) |
| $t_{T1}$ | START OF TRANSFORMATION (METHOD 1) |
| $t_{DR}$ | DYNAMIC RECRYSTALLIZATION |
| $t_C$ | CONTROLLED COOLING |
| $t_{T2}$ | START OF TRANSFORMATION |
| $t_{Ch}$ | LOADING THE FURNACE |
| $t_{SR}$ | STATIC RECRYSTALLIZATION |

$t_{SR} - t_{T2} - t_{DR}$

—— METHOD 1 (STATE OF ART)

- - - - METHOD 2 (INVENTION)

METHOD FOR PRODUCING HOT-ROLLED STRIPS AND PLATES

BACKGROUND OF THE INVENTION

The invention pertains to a method for producing hot-rolled strip and plates in a production plant consisting of a continuous-casting installation for slabs with a thickness of 100–180 mm and an exit temperature from the continuous casting installation of more than 1,000° C., a heating furnace, and a Steckel mill.

In a production plant known under the name "FFM" (Flexible Flat Mill) for the production of both hot-rolled strip and plates, a slab with a thickness of 100–180 mm is transported directly from the continuous casting machine over a roll table to the heating furnace, loaded while hot into the furnace, heated, and after leaving the heating furnace rolled into strip or into one or more plates in a one-stand or multi-stand Steckel mill.

The temperature of the slab after leaving the continuous casting machine is usually between 1,000° C. and 1,150° C. and decreases as it is being transported to the heating furnace on the roll table. The direct, hot loading into the heating furnace occurs at temperatures of 750–950° C. In the heating furnace, the slab is heated uniformly over its thickness, width, and length to a temperature of 1,050–1,280° C., depending on the material.

Characteristic of the hot loading technique is that, before the first deformation across the thickness of the slab on the rolling line, little or no austenite-ferrite/pearlite transformation occurs in the surface region if the surface temperatures do not fall below or fall only slightly below the transformation temperatures as the slab is being transported from the continuous casting machine to the heating furnace. The coarse-grained primary austenite which forms during solidification of the slab remains preserved for the most part until deformation on the rolling line. The size of the austenite grain can become even larger in the heating furnace, depending on the type of material in question and on the heating technology used.

In comparison to cold loading, the hot loading technique offers savings in both heating energy and time during the heating process The technique of hot loading described above has been found reliable for steels with a copper content of less than 0.3%. At higher copper contents in the steel, the copper which is freed during scale formation in the heating furnace accumulates at the grain boundaries of the primary austenite. As a function of the copper content, the heating temperature, and scale formation, these copper accumulations at the grain boundaries can lead to material separations in the form of alligator cracks during deformation in the rolling mill.

To solve this problem, which also occurs in thin-slab casting and rolling mills, EP 0,686,702 A1 proposes that the surface temperature of 40–70 mm-thick slab be lowered to a point below the $Ar_3$ temperature in a cooling interval following the continuous casting machine, so that, in the surface region down who a depth of at least 2 mm, at least 70% of the austenite microstructure becomes transformed into ferrite/pearlite with reorientation of the austenite grain boundaries after reheating in the roller-hearth furnace. The average surface temperature should not fall below the martensite threshold of the starting stock during cooling in the cooling interval.

It is to be observed in general that, according to the state of the art for the rolling of ingots, billets, and slabs of a certain chemical composition, cracks or material separations occur when the technique of hot loading into the heating furnace is used as a direct coupling between the continuous casting machine and the rolling mill.

In JP 59[1984]-189,001, the rapid cooling of the skin layer in the area between the continuous casting machine and the heating furnace is proposed for billets of carbon steels with 5100 ppm of boron, 0.03–0.15% of sulfur, and 0.5–2.0% of silicon in order to prevent cracks in the stock during rolling.

In EP 0,587,150 A1, AlN segregations during hot loading are held responsible for cracks in the stock during the rolling of aluminum killed steels with 0.008–0.030% of N and 0.03–0.25% of Pb. It is recommended that, to suppress the AlN segregations, the skin layer of the blooms be cooled rapidly with microstructural transformation in the bainite region. The rapid cooling takes place between the continuous casting machine and the heating furnace.

In U.S. Pat. No. 5,634,512, segregations of Al, V, and N during hot loading are given as the cause of cracks in blooms, billets, and slabs as a result of the tensile stresses which develop during air cooling. It is proposed here, too, that the skin layer be cooled rapidly to a depth of at least 10 mm to a temperature of 400° C., followed by a self-temper to 900° C. by the residual heat flowing from the core. The device for rapid cooling is located between the continuous casting machine and the heating furnace. A material-specific control mechanism and closed-loop control is provided for the cooling device.

BRIEF DESCRIPTION OF DRAWINGS

FIGS. 1*a*, 1*b* and 2 show a comparison between state of the art conventional method 1 to the present invention method 2.

A common feature of the state of the art is that the actual causes, processes, or mechanisms which lead to cracks and separations when the hot loading technique is used in the processing line leading from the continuous casting machine to the heating/soaking furnace and from there to the rolling mill have not yet been completely clarified. It is possible that a combination of several of the causes indicated is responsible. In general, however, the recommendation according to the state of the art is rapidly to cool the skin layer of the continuously cast strands to a temperature below the transformation point and then to let it temper with the heat flowing back from the core. The danger that the surface temperature will in part fall below the martensite threshold is present in all of the cited patents, as indicated in FIG. 1*a* by the solid line illustrating the state of the art. FIG. 1*a* shows the change in the surface temperature over time.

Figure 2:
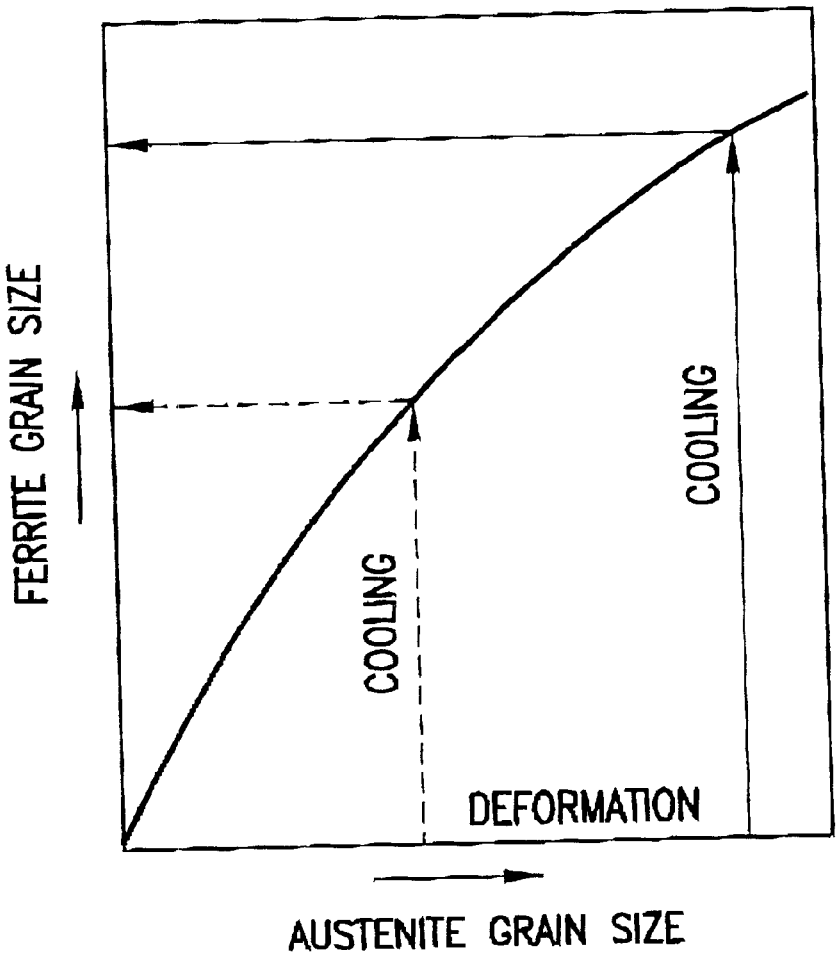

According to the state of the art, the devices for rapid cooling are to be installed between the continuous casting machine and the heating or soaking furnace. The partial transformation of the skin layer into ferrite/-pearlite is associated with grain refinement and a reorientation of the austenite grain boundaries after reheating, as can also be seen from the course of the solid line indicating the state of the art in FIGS. 1*b* and 2.

Studies have shown, furthermore, that, in the case of steels with a copper content of greater than 0.3%, with 0.02–0.05% of Al, 0.008–0.020% of N, and a copper/nickel ratio of greater than 3, cracks or separations occur when the slab is rolled into strip and plates regardless of whether or not the skin layer of the slab has been cooled rapidly with partial microstructural transformation after it has left the continuous casting machine and before it has been loaded into the heating furnace.

SUMMARY OF THE INVENTION

The task of the present invention is to guarantee that, in a combined hot-rolled strip/plate production system of the general type described above, even steels with relatively large amounts of Cu, Al, and N can be processed without disadvantage.

It is proposed in accordance with the invention that, between the continuous casting machine and the heating furnace, only the skin layer of a previously descaled slab be deformed in-line, recrystallized during and after deformation, and then cooled in multiple stages to a temperature below the $Ar_3$ transformation point and temporarily held there until the microstructural transformation of the recrystallized, fine-grained austenite into ferrite/-pearlite is complete In terms of the equipment required, this means that, before the slab is loaded into the heating furnace, it passes through a surface deformation group consisting of descaling sprays, a single- or multiple-stand rolling unit with or without integrated edging, and a cooling interval with a control mechanism and closed loop control. The surface is completely descaled by the descaling sprays.

In an elaboration of the invention, it is provided that the slab be deformed with a total reduction of 5–15% using a diameter-optimized roll gap ratio $l_d/h_m$ of less than 0.8. The rolling speed is the same as the casting speed. Through optimization of the diameters of the rolls and the extent of the reduction, the proposed roll gap ratio of compressed length to average height of the stock is adjusted in such a way that, according to another feature of the invention, through the selection of the reduction and roll gap ratio, the surface region corresponds to a thickness of no more than one-fourth of the thickness of the slab, whereas the core region remains virtually undeformed.

As a result of deformation, the surface region of the continuously cast strand recrystallizes in the roll gap of the stand in question of the rolling unit in either a partially or completely dynamic manner, depending on the deformation conditions. After emerging from the roll gap of the stand in question of the rolling unit, the deformed skin layer of the stock then undergoes partial to complete static recrystallization. FIG. 1*a* shows the change in temperature of the skin layer as a dotted line. As a result of the dynamic and static recrystallization, the grain of the marginal surface layer becomes refined (compare FIG. 1*b*, broken line); that is, the coarse-grained primary austenite is changed into a rolled, fine-grained structure.

To prevent the grain size in the skin layer from increasing as a result of the still high temperatures of 850–1,050° C., this layer is cooled in several stages in a cooling interval after completion of the recrystallization process. During this cooling, the temperature also falls below the $Ar_3$ transformation point, as a result of which the grain of the skin layer, which has been recrystallized and refined by rolling, is transformed into a ferritic/-pearlitic structure even finer than that obtained by conventional method 1, this transformation also occurring much more quickly (see FIGS. 1 and 2).

According to the invention, the intensity of the cooling interval consisting of several groups of nozzles is controlled by a control mechanism and closed loop control so that the surface temperature of the slab neither reaches the bainite region nor falls below the martensite threshold of the starting stock.

Multi-stage cooling of the skin layer is continued until 100% of the recrystallized and refined austenite grain has been transformed into ferrite/pearlite. For this purpose, it is proposed that a control mechanism and closed-loop control be used to control the media pressure of the nozzle groups of the cooling interval as a function of slab thickness, the casting speed, and the average temperature of the skin layer, while maintaining the cooling temperature and time required for 100% microstructural transformation, and avoiding the bainite start temperature and the martensite start temperature of the starting stock.

As a result of combining the deformation of the skin layer with step-wise cooling below the $Ar_3$ transformation temperature, the ferritic/pearlitic structure which develops by the time the slab is loaded into the heating furnace is much finer than that of the conventional method (see FIG. 1*b*). In addition, a complete reorientation of the austenite grain boundaries together with a much finer grain is achieved as a result of the microstructural transformation which occurs during reheating.

Thus, while there have been shown and described and pointed out fundamental novel features of the present invention as applied to a preferred embodiment thereof, it will be understood that various omissions and substitutions and changes in the form and details of the devices illustrated, and in their operation, may be made by those skilled in the art without departing from the spirit of the present invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

What is claimed is:

1. A method for producing hot-rolled strip and plates in a production plant including a continuous casting installation for slabs 100–180 mm thick, descaling sprays, a single- or multiple-stand rolling unit with or without integrated edging, a cooling interval, a heating furnace, and a Steckel mill, the method comprising the steps of: deforming only a skin layer of a previously descaled slab in-line between the continuous casting installation and the heating furnace; recrystallizing the slab during and after deformation; and then cooling the slab in several stages to a temperature below the $Ar_3$ transformation point and temporarily maintaining the temperature below the $Ar_3$ transformation point until a microstructural transformation of the recrystallized, fine-grained austenite to ferrite/pearlite has been completed.

2. A method according to claim 1, wherein the deforming step includes deforming the slab with a total reduction of 5–15% using a diameter-optimized roll gap ratio $l_d/h_m$ of less than 0.8.

3. A method according to claim 2, including selecting the reduction and the roll gap ratio so that a deformed surface region corresponds to a thickness equal to at most one-fourth of the thickness of the slab.

4. A method according to claim 1, wherein the cooling step includes cooling with several groups of nozzles, the method further including controlling intensity of the cooling with a control mechanism and closed-loop control so that surface temperature of the slab neither reaches the bainite region nor falls below the martensite threshold of the slab starting stock.

5. A method according to claim 4, wherein the step of controlling cooling intensity includes regulating media pressure of the groups of nozzles of the cooling interval with the control mechanism and closed-loop control as a function of the thickness of the slab, casting speed, and average temperature of the skin layer while maintaining cooling temperature and time required for 100% micro-structural transformation and avoiding the bainite start temperature and the martensite start temperature of the starting stock.

* * * * *